United States Patent [19]

Reichelt et al.

[11] Patent Number: 4,836,271

[45] Date of Patent: Jun. 6, 1989

[54] CASTING APPARATUS FOR CASTING METAL STRIP, IN PARTICULAR, STEEL STRIP

[75] Inventors: Wolfgang Reichelt, Moers; Matthias Scheulen, Jünkerath; Klaus Schwerdtfeger, Goslar; Peter Voss-Spilker, Kempen; Ewald Feuerstacke, Dorsten, all of Fed. Rep. of Germany

[73] Assignee: Mannesmann Aktiengesellschaft, Dusseldorf, Fed. Rep. of Germany

[21] Appl. No.: 166,969

[22] Filed: Mar. 11, 1988

[30] Foreign Application Priority Data

Mar. 12, 1987 [DE] Fed. Rep. of Germany ..... 3707897

[51] Int. Cl.[4] ..... B22D 11/06

[52] U.S. Cl. ..... 164/417; 164/429; 164/479

[58] Field of Search ..... 164/429, 423, 479, 463, 164/417, 476, 477

[56] References Cited

U.S. PATENT DOCUMENTS 2,348,178 5/1944 Merle ..... 164/429

*Primary Examiner*—Kuang Y. Lin

*Attorney, Agent, or Firm*—Thomas N. Ljungman

[57] ABSTRACT

In a process for casting metal strip, in particular steel strip, the liquid metal is discharged from a casting nozzle which has the same width as the strip onto a continuously moving, cooled conveyor belt, and the plane of the nozzle mouth is set for the thickness of the metal strip to be cast, i.e. at an acute angle to the plane of the conveyor belt. To maintain the casting speed at the nozzle mouth on the conveyor belt, i.e. to prevent shearing forces of the flow layers and thus a speed profile with negative components, the invention proposes that with a conveyor belt running at an inclination to the horizontal in the casting direction, the inclination of the conveyor belt in the casting direction is set as a function of the casting speed, which should be equal to the conveyor belt speed, and as a function of the material parameters of the liquid metal.

19 Claims, 6 Drawing Sheets

14
17
16
1
13
46
5b
5
5a
15
7
V
5c
9

17a
14
5
5a
13
15
1
5b
5c
V
9
11

21
22
24
4a
4
27
26
44
45
1
54
57
25
53
55
56
5
2
20
3
19
3a
23
5a
5b

CASTING APPARATUS FOR CASTING METAL STRIP, IN PARTICULAR, STEEL STRIP

BACKGROUND OF THE INVENTION

1. Field of the Invention:

This invention relates to an apparatus for casting metal strips, in particular, steel strips, comprising a liquid metal reservoir with a casting nozzle and a molding apparatus for the cast strip, in which the liquid metal reservoir and molding apparatus are housed in a frame, whose inclination from the horizontal can be adjusted.

2. Description of the Prior Art:

Such an apparatus, with a frame whose inclination can be adjusted, is described in German Patent Publication published for Opposition Purposes No. DE-AS 21 16 870. It is used to cast non-ferrous metals in metal strip thicknesses of several millimeters. The prior art does not include any practical, advantageous embodiment for use with steel as the liquid metal.

U.S. Pat. No. 4,719,963 corresponding to German Laid Open Patent Appln. No. DE-OS 35 21 778 and European Patent Appln. No. EP-A 0208890 describe casting on a horizontally oriented, flat conveyor belt, whereby the casting moves along so that, taking into consideration the wedge-shaped solidification front which forms in the vicinity of the nozzle during casting on the moving cooling surface of the cooling frame (conveyor belt), and by adjusting the speed of the cooling surface, the open gap between the discharge side nozzle lip and, if any, the lateral nozzle lips, there can be a gradual increase from a low initial value to prevent an uncontrolled discharge of the liquid metal to that of the desired strand thickness, to achieve a final value which prevents an uncontrolled breakout. Such a process depends on an instantaneous acceleration of the liquid metal in the direction in which the liquid metal exits, starting from the casting nozzle in the direction of movement of the cooled conveyor belt. The speed differences which occur produce an unpredictable flow gradient, so that the desired thickness is difficult to control, and differences in thickness cannot be prevented.

All of the above-mentioned patent applications are incorporated herein by reference as if the entire contents thereof were fully set forth herein.

OBJECT OF THE INVENTION

The object of the invention is to improve the dynamic and fluidic conditions at the start of casting and during continuous casting.

SUMMARY OF THE INVENTION

The object of the invention is achieved with the features described herein.

With the casting apparatus according to the invention, only a weak deflection of the partial laminar flows is achieved with acceleration of individual layers in the direction of movement of the conveyor belt, so that the most laminar possible flow is achieved on the cooled conveyor belt. The discharge velocity at the end of the casting nozzle thereby becomes approximately equal to the speed of the conveyor belt. The parameters to be taken into consideration are, in particular, the thickness of the metal strip, the superheating temperature, and the characteristics of the steel grades in question.

To start the casting process, the conveyor belt is gradually tipped from the approximately horizontal starting position of the impact surface of the liquid metal into the inclined position. One advantage of the configuration of the casting apparatus is that it is possible to set a joint inclination of the liquid metal reservoir and the conveyor belt plane, as well as a separate setting between the liquid metal reservoir and the conveyor belt plane, where, in addition to the inclination, the vertical distance is also taken into consideration.

Another improvement is that on the frame, there is a sliding guide for an adjustable slide, on which are located the liquid metal reservoir and at least hoisting devices for the liquid metal reservoir. The liquid metal reservoir can be adjusted on one hand in relation to the conveyor belt, or it can be moved entirely out of the vicinity of the conveyor belt, to provide access to the conveyor belt.

Further improvements in the sense of an inclined conveyor belt for different operating conditions are achieved in that there is a support for the cooled conveyor belt between the drums, that the support has a continuous contour, which runs over a tangent to the drum circumference, and that at least in the vicinity of the casting nozzle of the liquid metal reservoir, there is a travelling seal located on the side, which matches the curve of the continuous contour of the support or of the cooled conveyor belt. The height of the seal is at least equal to the thickness of the cooled conveyor belt plus the thickness of the cast strip. This advantageously creates an inclined base to guide the conveyor belt and, among other things, to absorb the weight of the cast strip. The continuous contour also creates a foundation for a base connected with the inclination adjustment, to set the most favorable flow conditions. The travelling seal therefore solves the problem of a lateral breakout of the cast material, and minimizes lateral thickness differences over the cross section of the cast strip. Considered over the width of the cast strip, it is also advantageous that there is a cooled skin pass roll on the plane of the cooled conveyor belt, at the distance of the thickness of the cast strip. The purpose of this roller is to achieve an improved surface quality on the surface of the cast strip facing away from the conveyor belt.

In one configuration of the invention, the cooled skin pass roll is located in the vicinity of the casting nozzle of the liquid metal reservoir. The skin pass is therefore performed in a certain heat range, in which it is advantageous to act on the surface.

An advantageous measure to protect the conveyor belt comprises the introduction of a cooling medium under pressure between the arched support and the cooled conveyor belt. The cooling for the conveyor belt is therefore increased, so that a significant amount of heat can be removed during cooling of the cast strip.

In another advantageous configuration of the invention, the drum on the casting side, which is in the vicinity of the casting nozzle, has a guide for the cooled conveyor belt. Such a guide reduces possible wear between the lateral, travelling seal at the level of the conveyor belt.

Another improvement is that the drum on the casting side has a cleaning or spraying apparatus for application of a lubricant which advantageously facilitates the release of the cast strip from the conveyor belt.

Other characterisitics of the invention provide that the lateral, travelling seal comprises metallic elements which form a flat surface in the operating position.

To protect the surface of the cast strip from reoxidation, the invention comprises a casting space which is formed between the casting nozzle of the liquid metal reservoir, the cooled conveyor belt guided on the support, the skin pass roll and the lateral travelling seal. This casting space is filled with inert gas.

The consumption of inert gas can also be limited by a shroud located downstream of the skin pass roll in the casting direction, to protect against oxidation.

One aspect of the invention resides broadly in a continuous casting apparatus for casting metal strip, the casting apparatus including: an arrangement for containing molten metal, the molten metal containing arrangement having a casting nozzle; a conveyor belt disposed in proximity of the casting nozzle for receiving molten metal from the casting nozzle; an arrangement for cooling and thus solidifying the molten metal on the conveyor belt; the arrangement for cooling the molten metal disposed in proximity of the conveyor belt; an arrangement for driving the conveyor belt past the casting nozzle; a support arrangement for supporting the conveyor belt at least under the molten metal on the conveyor belt; an arrangement for mechanically making contact with and mechanically working at least an upper surface of the metal discharged from the casting nozzle; and an arrangement for disposing the conveyor belt in selectable positions, the arrangement for disposing the conveyor belt in a selectable position including an arrangement for varying the inclination, from horizontal, of the molten metal while forming the strip.

Other characteristics are illustrated in the accompanying drawings.

One embodiment of the invention is illustrated in the drawings and is explained in greater detail below.

DESCRIPTION OF THE PREFERRED EMBODIMENTS

Figure 1:
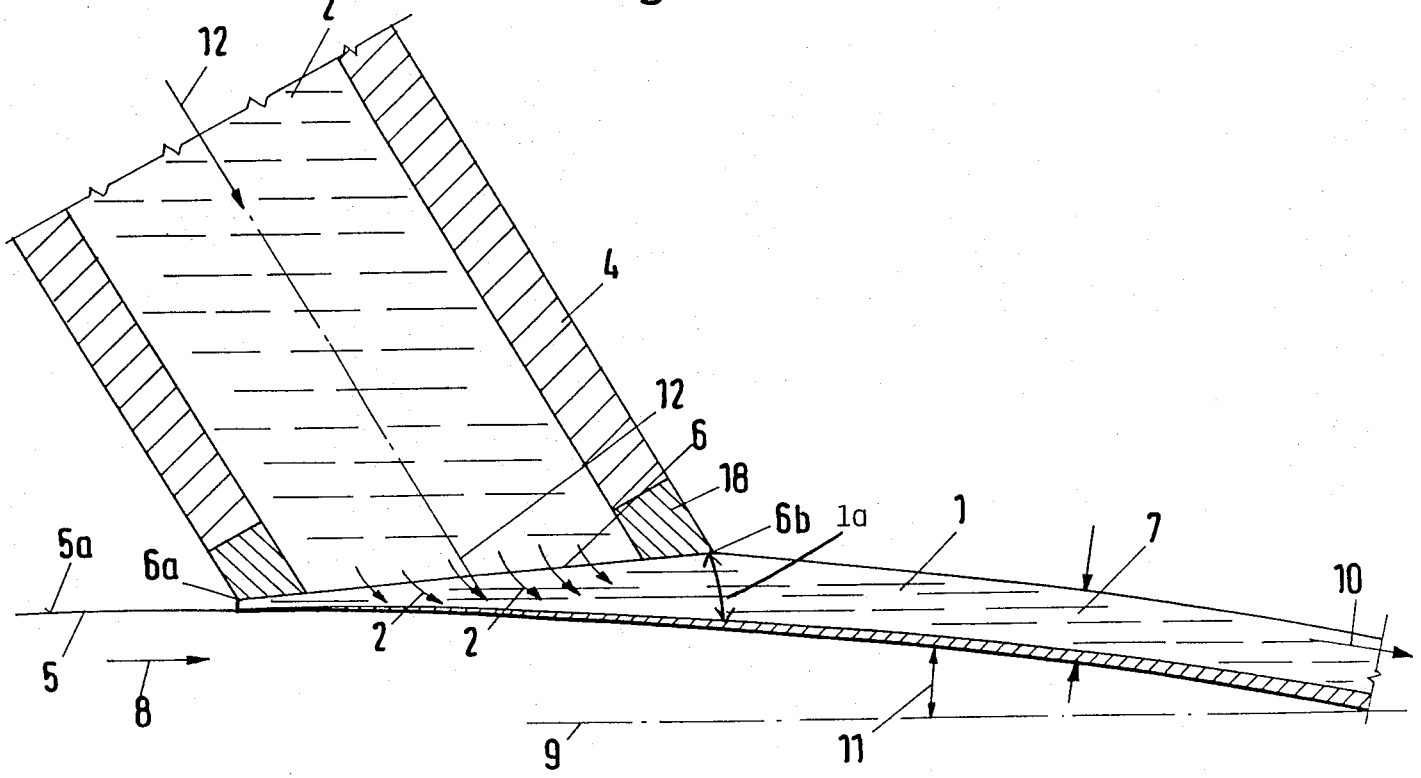
FIG. 1 is a drawing in cross section through the casting nozzle, to illustrate the process.

Referring now to FIG. 1 the cast strip 1 is produced from liquid metal 2 such as liquid steel, which flows from a liquid metal reservoir 3 through a casting nozzle 4 and onto a conveyor belt 5. The nozzle mouth 6, the plane of which extends over the width 1*a*, is set to the thickness 7 of the cast strip 1 by placement at an acute angle in relation to the conveyor belt plane 5*a* of the conveyor belt 5. The angular adjustment is made so that the nozzle mouth 6 is sealed at its rear portion 6*a* in the direction of movement 8 by the surface pressure of the liquid metal 2 that is produced by a meniscus, thereof. Its front portion 6*b* in the direction of movement 8 is at an acute angle in relation to the plane of the conveyor belt 5*a*, and this position produces the thickness 7.

The conveyor belt 5*a* is at an acute angle 11 in relation to the horizontal 9 in the casting direction 10. The acute angle 11 is formed by the corresponding arch or curvature of the path of the conveyor belt plane 5*a*.

The inclination of the conveyor belt 5 in relation to the horizontal 9 in the casting direction 10 is set as a function of the casting speed and the material parameters of the liquid metal (e.g. metal strip thickness 7, superheating temperature, grade of steel, etc.), so that the discharge speed 12 inside the casting nozzle 4 is equal to the speed of the conveyor belt 15. Conversely, of course, the conveyor belt speed 15 can also be adjusted to match the dimensions of the casting nozzle, and the discharge speed 12 can be adjusted to match the discharge speed of the conveyor belt 15.

The operation of turning on the conveyor belt 5 (FIGS. 2 and 3) starts from an approximately horizontal starting position of the impact point 13 for the liquid metal 2. In this position of the conveyor belt 5, the speed profile 14, with a corresponding conveyor belt speed 15, has a negative speed component in the direction of the arrow 16 with respect to the speed of the belt 5 in the upper region, which ultimately leads to an overall smaller speed distribution 17. Here, shearing forces occur within the flow of the liquid metal 2, which can only partly be overcome, because there is already a tendency toward inclination at the impact point 13. During start-up, therefore, this condition is rapidly overcome by tipping the conveyor belt 5 (FIG. 3), so that at an elevated flow velocity, the speed profile 14 increases rapidly, and results in the new speed distribution 17*a*. In other words, the original negative speed component is decreased.

Figure 2:
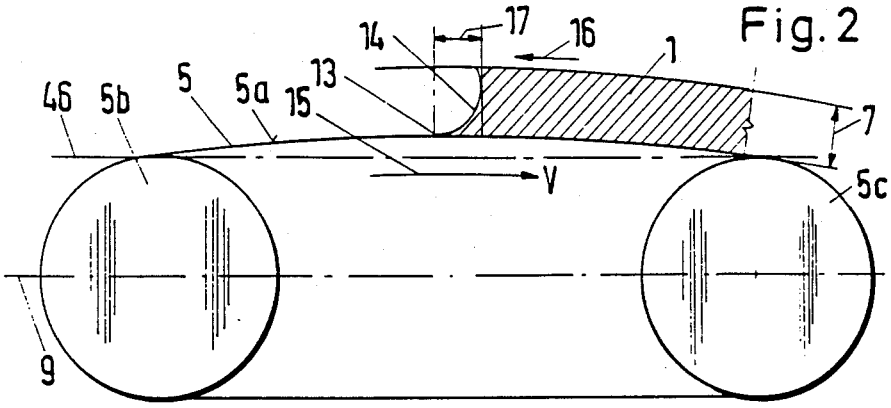
FIG. 2 is a schematic diagram of the conveyor belt in the casting phase.
Figure 3:
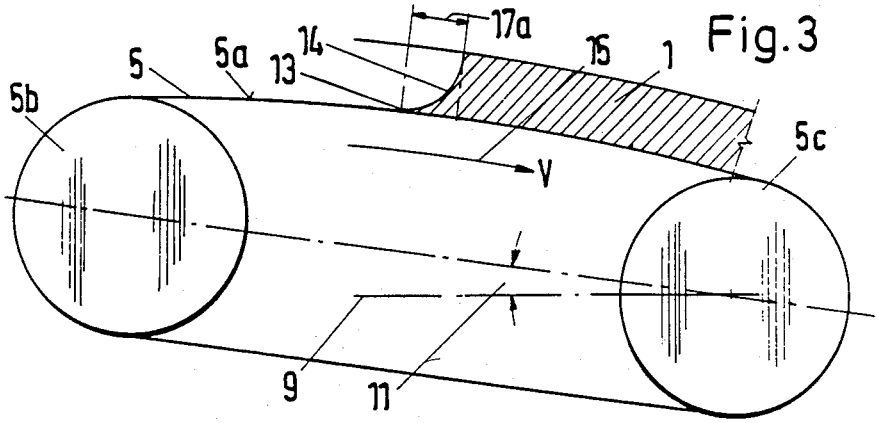
FIG. 3 is a schematic diagram as in FIG. 2, in the phase following casting.

In FIGS. 2 and 3, the thickness 7 of the cast strip is shown greatly enlarged, to more clearly illustrate the speed profile 14. In addition, the speed profile 14 in the front portion 6*b* of the nozzle mouth 6 is advantageously influenced also by a breaker ring 18, which corresponds approximately to the breaking rings inside a horizontal continuous casting mold customarily used in horizontal continuous casting, i.e., one which is made of boron nitrite, for example, but which continuously breaks off the liquid metal.

The casting apparatus for cast strip 1 with a thickness 7 of several millimeters has a liquid metal reservoir 3 (FIG. 4), which is equipped with a lining 19, a partition 20, a cover 21 and the casting nozzle 4. The casting nozzle 4 is mounted in a casting block 22, and is held in place by means of a retaining ring 23 fastened to the reservoir jacket 3*a* and a conical nipple 24. The casting nozzle 4 is therefore easy to remove and replace. Around the front portion 4*a*, there is either a cooling device 25 or a heating device 26, the two of which can also be combined into one device, and turned on or off depending on the temperature of the liquid metal 2. Behind the casting nozzle 4 in the casting direction 10, above the conveyor belt plane 5*a* at the distance of the thickness 7 of the cast strip 1, there is an adjustable, cooled skin pass roll 27, the length of which equals the width of the cast strip 1. The skin pass roll 27 is also mounted in a pivot bearing 28 (FIG. 5), which is supported on a pair of articulated arms 29 and a pair of columns 30. A hydraulic pair of hoisting gears 31 is used to move the skin pass roll 27.

Figure 6:
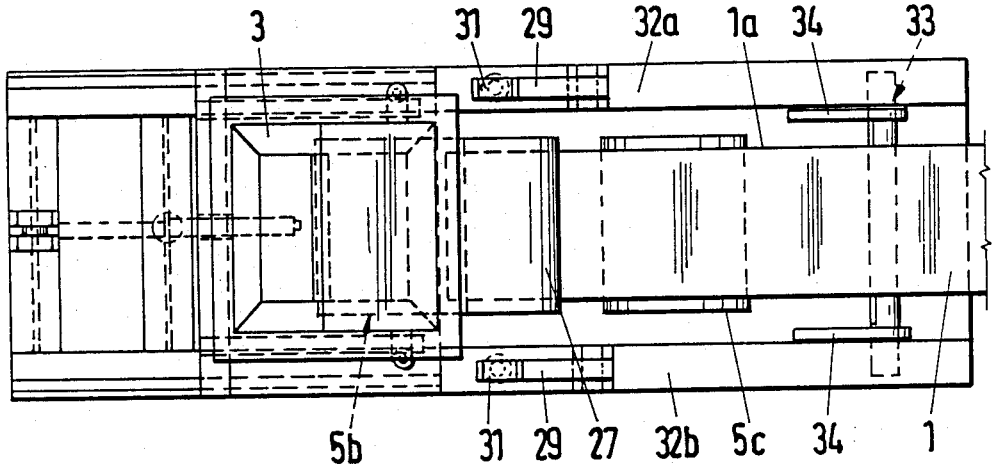
FIG. 6 is a plan view of the total casting apparatus shown in FIG. 5.

The liquid metal reservoir 3 for the liquid metal 2 and the drums 5*b* and 5*c* with the conveyor belt 5 are located in a frame 32 shown in FIG. 6. The frame 32 comprises two parallel beams 32*a* and 32*b* of FIG. 6. The frame 32 can be pivoted around the horizontal axis 33 of the pair of pillow blocks 34 by means of a piston-cylinder, preferably hydraulic or pneumatic, drive mechanism 36 located on and linked to the floor 35 and linked to the frame 32. The liquid metal reservoir 3, as explained in greater detail below, is adjustable on the frame 32 in terms of height and its inclination in relation to the plane 5*a* of the conveyor belt. Also on the frame 32 is a sliding guide 37 for an adjustable slide 38. The slide 38 supports the liquid metal reservoir 3 and a hoisting mechanism 39 for the liquid metal reservoir 3. The slide 38, shown here, is a car 38*a* with wheels 40, which can move horizontally. The slide 38 has a drive for this purpose in the form of a displacement cylinder 41, whose cylinder housing 42 is linked to the sliding guide 43 at 43*a*.

For the cooled conveyor belt, between the drums 5*b* and 5*c*, there is a support 44 (FIG. 4), which has a special contour 45 opposite the skin pass roll 27. The contour 45 has a continuous curve, runs in a continuous but arched path above a tangent 46 to the circumference of the drum (FIG. 2). In the vicinity of the casting nozzle 4 of the liquid metal reservoir 3 there is a travelling seal 47 which projects above the thickness of the cast strip 1 and is fitted to the curve of the continuous contour 45. The travelling seal 47 is flexible and guided by roller pairs 48 and 49. The travelling seal 47 may include a flexible belt which is made of a material, which is resistant to the effects of the molten metal, such as metal. The axes 50 of the roller pairs 48 and 49 accordingly run perpendicular or at an angle to the horizontal 9. The flexible seal 47 preferably comprises metallic elements 52 which form a flat surface 51 in the operating position.

Figure 4:
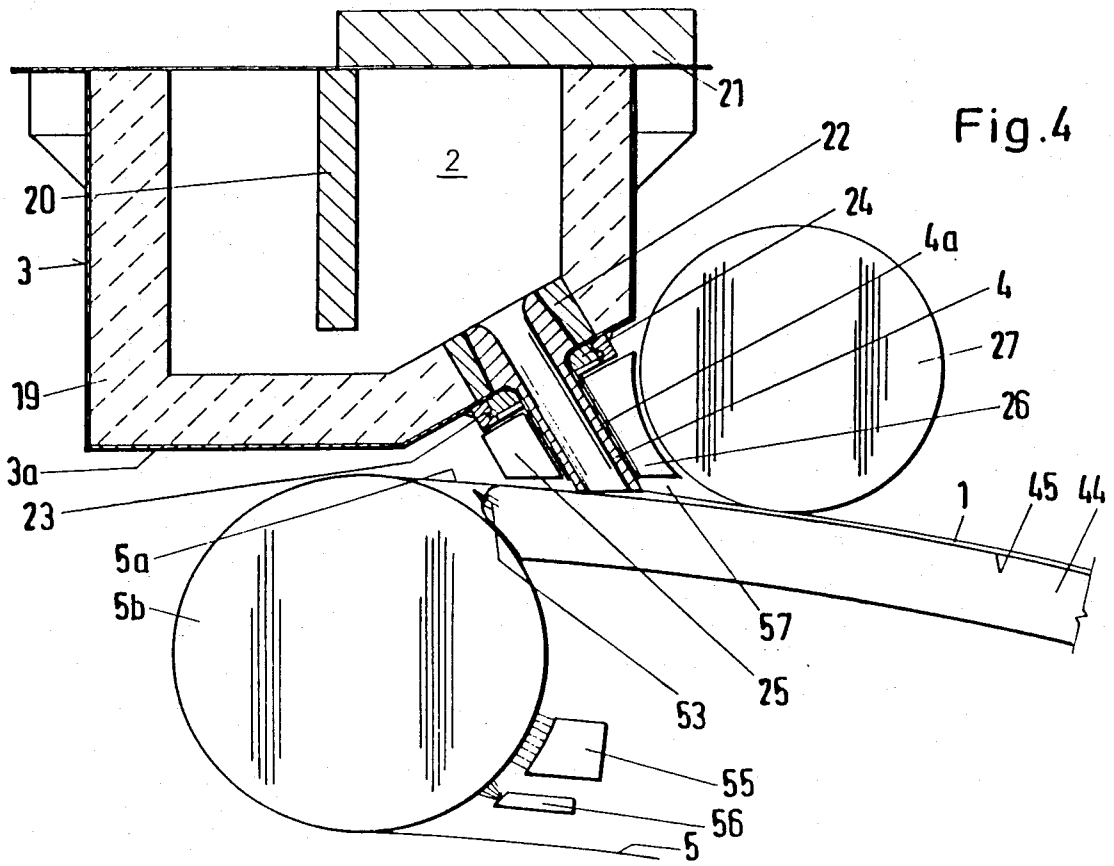
FIG. 4 is a vertical cross section through the liquid metal reservoir and the casting nozzle, with conveyor belt and skin pass roller.
Figure 7:
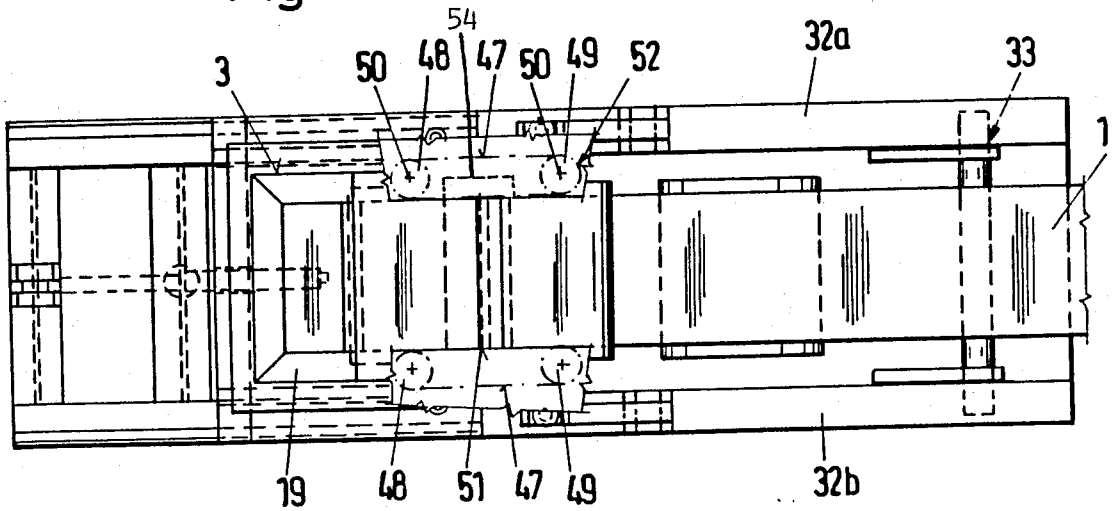
FIG. 7 is a plain view of the portion of the casting apparatus with the travelling lateral seal.
Figure 8:
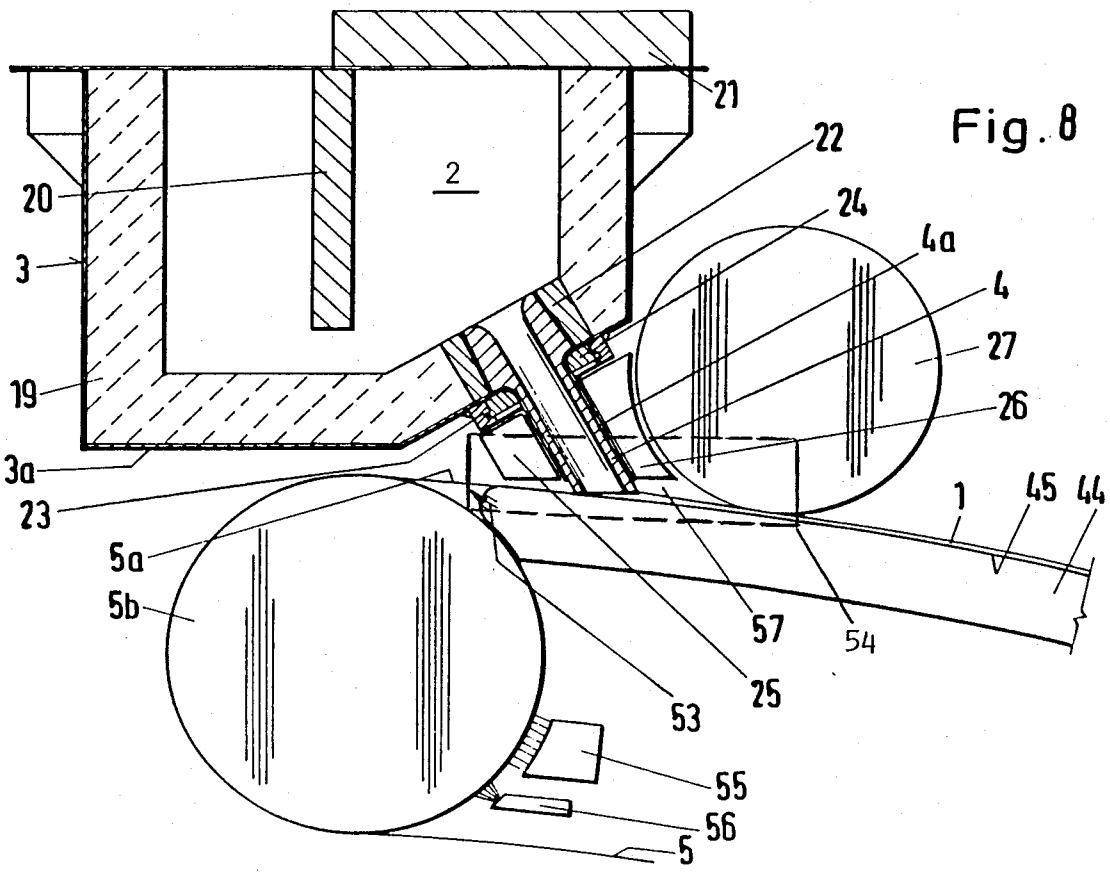
FIG. 8 is a vertical cross section through the liquid metal reservoir and the casting nozzle, conveyor belt and skin pass roller; and with a guide.

Referring again to FIG. 4, a coolant 53 is introduced under pressure between the arched support 44 and the conveyor belt 5. The conveyor belt 5 is also laterally guided in the vicinity of the casting nozzle 4 by a guide 54 (FIG. 7), to minimize wear to the flexible seal 47. The casting side drum 5*b* also comprises a cleaning apparatus 55 and a spraying apparatus 56 (FIG. 4).

Figure 5:
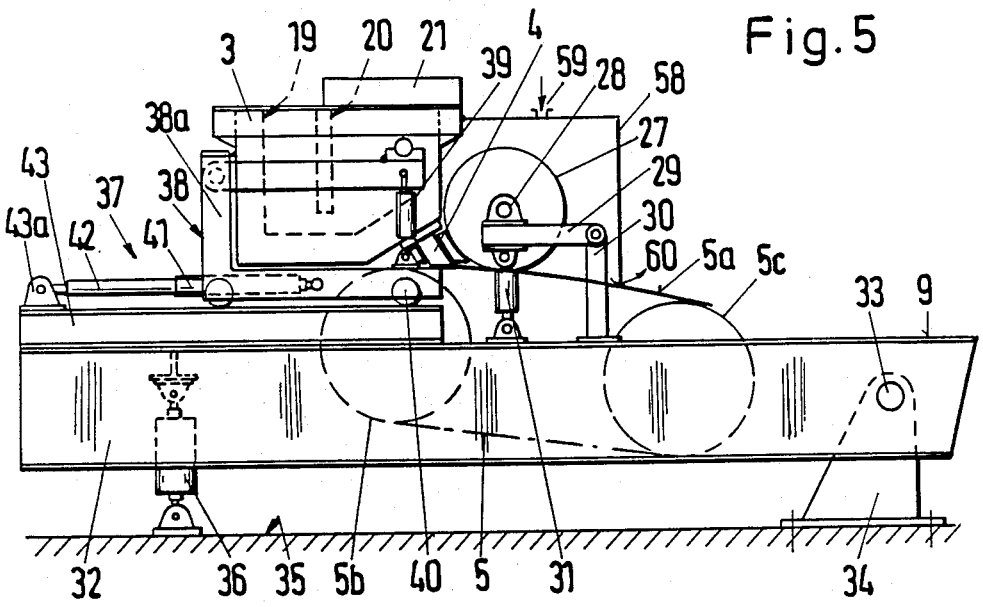
FIG. 5 is a side view of the entire casting apparatus.

A casting space 57 (FIG. 4) is formed between the casting nozzle 4 of the liquid metal reservoir 3, the cooled conveyor belt 5 guided on the support 44, the skin pass roll 27 and the lateral, travelling seal 47. The casting space 57 is filled with an inert gas, e.g., argon or nitrogen, and is therefore surrounded by a shroud 58 (FIG. 5). The inert gas flows into the shroud 58, through a pipeline 59, and exits via a gap 60, and therefore keeps the oxygen in the air away from the cast strip 1 during solidification.

In summing up, an embodiment of the invention resides in a casting apparatus for casting metal strip, in particular steel strip, which includes a liquid metal reservoir with a casting nozzle and a molding apparatus for strip casting. The liquid metal reservoir and the molding apparatus are mounted on a frame, the slope of which is adjustable in relation to the horizontal. The molding apparatus includes a conveyor belt 5 which is cooled on one side and is guided by two rotating drums 5*b*, 5*c* which are located at some distance from one another. The molding apparatus also includes a nozzle mouth 6, a casting nozzle 4, and a travelling seal 47, the travelling seal 47 is located at least in the vicinity of the casting nozzle 4. The conveyor belt 5 is supported on a support 44 located between the drums 5*b*, 5*c*. There is a cooled, skin pass roll 27 at the distance of thickness 7 of the cast strip 1 from the conveyor belt plane 5*a*. This cooled, skin pass roll 27 is in the vicinity of the casting nozzle 4.

Another aspect of the invention resides in that the height and the slope of the liquid metal reservoir 3 on the frame 32 are adjustable in relation to the plane 5*a* of the conveyor belt.

A further aspect of the invention resides in the frame 32 on which there is a sliding guide 37 for an adjustable slide 38, on which is located a liquid metal reservoir 3, and hoisting equipment 39 for the liquid metal reservoir 3.

Yet another aspect of the invention resides in that the support 44 has a continuous contour 45, which runs over a tangent 46 to the drum circumference.

Still another aspect of the invention resides in the seal 47 which is fitted to the curve of the continuous contour 45 of the support 44 or of the conveyor belt 5, and which has a height equaling at least the thickness of the cooled conveyor belt 5 plus the thickness 7 of the cast strip.

Yet still another aspect of the invention resides in the coolant 53 which is under pressure and is introduced between the arched support 44 and the cooled conveyor belt 5.

And still yet another aspect of the invention resides in a casting drum 5*b* which is located in the vicinity of the casting nozzle 4, and which comprises a guide 54 for the cooled conveyor belt 5.

And yet a further aspect of the invention resides in a casting drum 5*b* which comprises a cleaning and/or spraying apparatus 55, and 56 which apply lubricants.

And still yet a further aspect of the invention resides in a lateral, travelling seal 47 which is comprised of metallic elements 52 which form a flat surface 51 in the operating position.

A still further aspect of the invention resides in a casting space 57 which is filled with inert gas and is formed between the casting nozzle 4 of the liquid metal reservoir 3 and the cooled conveyor belt 5 which is guided on the support 44, the skin pass roll 27, and the lateral, travelling seal 47.

And still yet another aspect of the invention resides in that the downstream of the skin pass roll 27 in the casting direction 10, there is a shroud 58 which protects against oxidation 58.

Some examples of patents relating to casting include the following: U.S. Pat. No. 4,719,963, entitled "Process for the Production of a Metal Strand, More Particularly in the Form of a Strip or Section, by Casting and Apparatus for the Performance of the Process"; U.S. Pat. No. 4,614,218, entitled "Vacuum Belt Hugger for Casting of Ribbon"; U.S. Pat. No. 4,570,697, entitled "Method of Treating Final Continuous Cast Strand in a Horizontal Continuous Casting Process"; U.S. Pat. No. 3,964,963, entitled "Apparatus for Producing Continuous Cast Metallic Sheet with Patterned Surface"; and U.S. Pat. No. 4,290,476, entitled "Nozzle Geometry for Planar Flow Casting of Metal Ribbon"; and U.S. Pat No. 3,923,091, entitled "Method for Supervising Skin Thickness in a Solidifying Body Such as a Continuously Cast Ingot"; and U.S. Pat. No. 4,022,369, entitled "Curved Roller Track for Continuously Cast Ingots"; and U.S. Pat No. 4,149,580, entitled "Method of Ascertaining the Effectiveness of Cooling Roller in Continuous Casting Machines"; and U.S. Pat. No. 4,452,298, entitled "Method and Apparatus for Cooling Continuously Cast Metal Strands". All of the above-mentioned patents are incorporated herein by reference as if the texts thereof were fully set forth herein.

The invention as described hereinabove in the context of the preferred embodiments is not to be taken as limited to all of the provided details thereof, since modifications and variations may be made without departing from the spirit and scope of the invention.

What is claimed is:

1. A continuous casting apparatus for casting metal strip, said casting apparatus comprising:

means for containing molten metal;

said molten metal containing means having a casting nozzle;

a conveyor belt disposed in proximity of said casting nozzle for receiving molten metal from said casting nozzle;

means for cooling and thus solidifying said molten metal on said conveyor belt;

said means for cooling said molten metal disposed in proximity of said conveyor belt;

means for driving said conveyor belt past said casting nozzle;

support means for supporting said conveyor belt at least under said molten metal on said conveyor belt;

means for mechanically making contact with and mechanically working at least an upper surface of said metal discharged from said casting nozzle; and means for disposing said conveyor belt in selectable positions, said means for disposing said conveyor belt in a selectable position including means for varying the inclination, from horizontal, of said belt.

2. The continuous casting apparatus for casting metal strip according to claim 1, further including means for sealing the sides of said conveyor belt such as to prevent metal from leaving said conveyor belt along the sides thereof.

3. The continuous casting apparatus for casting metal strip according to claim 2, wherein said sealing means includes means for moving at least a surface of said sealing means, said sealing means being disposed in proximity of said casting nozzle.

4. The continuous casting apparatus for casting metal strip according to claim 1, including means for adjusting said casting nozzle for providing cast metal strip in a predetermined range of thicknesses, and further said means for mechanically making contact having means for selectively disposing said contact making means away from said conveyor belt at a distance being substantially equal to the thickness of the metal strip being cast.

5. The continuous casting apparatus for casting metal strip according to claim 1, wherein said molten metal containing means has means for varying the pressure of the molten metal at least at the casting nozzle.

6. The continuous casting apparatus for casting metal strip according to claim 4, wherein said means for adjusting said casting nozzle includes means for varying an angular orientation of said casting nozzle with relationship to said conveyor belt for providing cast metal strip in a predetermined range of thickness.

7. The continuous casting apparatus for casting metal strip according to claim 1, wherein said mechanical contact making means comprises cooled roller means for working at least a skin portion of said molten metal being cast.

8. The continuous casting apparatus according to claim 1, wherein said conveyor belt driving means comprises drums for mounting said conveyor belt thereon.

9. The continuous casting apparatus according to claim 5, including means for varying a height of said nozzle in addition to adjusting an inclination of said nozzle with regard to said belt.

10. The continuous casting apparatus according to claim 9, including a frame for mounting said apparatus; and said means for varying a height of said nozzle and for adjusting an inclination of said nozzle with regard to said belt including means for moving said metal containing means, said moving means being disposed on said frame and including a sliding guide, an adjustable slide and hoisting means, said hoisting means being disposed for hoisting at least a portion of said metal containing means.

11. The continuous casting apparatus according to claim 7, wherein said support means has a continuous, contoured surface at least a portion of which is disposed tangentially to one of said drums.

12. The continuous casting apparatus according to claim 2, wherein said support means has a continuous, contoured surface at least a portion of which is disposed tangentially to one of said drums, and wherein said sealing means has means for fitting with at least one of said continuous, contoured surface of said support means and said conveyor belt; said sealing means having a height substantially equal to a dimension, said dimension being substantially equal to the sum of at least the thickness of the conveyor belt and the thickness of the strip as cast.

13. The continuous casting apparatus according to claim 1 including means for applying contact under pressure between said conveyor belt and said support means.

14. The continuous casting apparatus according to claim 7, wherein said drums comprise a first casting side drum disposed in the vicinity of the nozzle and a second drum, said casting side drum including a guide for the conveyor belt.

15. The continuous casting apparatus according to claim 13, including at least one of a cleaning means and a spraying means for applying lubricant.

16. The continuous casting apparatus according to claim 2, wherein said means for sealing comprising lateral, travelling seal means, said sealing means comprising metal elements for forming a flat surface in an operating position.

17. The continuous casting apparatus according to claim 1, including means for providing inert gas to a space about said casting nozzle and the region thereabout.

18. The continuous casting apparatus according to claim 16, wherein said means for sealing the sides of said conveyor belt such as to prevent metal from leaving said conveyor belt along the sides thereof, and said sealing means includes means for moving at least a surface of said sealing means, wherein said mechanical contact making means comprises cooled roller means for working at least a skin portion of said molten metal being cast, and said seal means comprising a lateral, travelling seal, and said roller means comprises a skin pass roll, and said region including at least a portion of said cooled conveyor belt, said pass roller, and said travelling seal.

19. The continuous casting apparatus according to claim 3, including a shroud for protecting the molten and solidifying metal on the conveyor belt against oxidation.

* * * * *